US010561181B2

(12) United States Patent
Pearson

(10) Patent No.: US 10,561,181 B2
(45) Date of Patent: Feb. 18, 2020

(54) FACE MASK HAVING A FLEXIBLE SKELETON AND A FLEXIBLE SKELETON FOR A FACE MASK

(71) Applicant: Dangerboo, LLC, Middleburg, VA (US)

(72) Inventor: Ian Pearson, Oak Park, IL (US)

(73) Assignee: DANGERBOO, LLC, Middleburg, VA (US)

( * ) Notice: Subject to any disclaimer, the term of this patent is extended or adjusted under 35 U.S.C. 154(b) by 196 days.

(21) Appl. No.: 15/662,882

(22) Filed: Jul. 28, 2017

(65) Prior Publication Data

US 2018/0035729 A1 Feb. 8, 2018

Related U.S. Application Data

(60) Provisional application No. 62/369,907, filed on Aug. 2, 2016.

(51) Int. Cl.

| | |
|---|---|
| ***A41D 13/11*** | (2006.01) |
| ***A62B 18/02*** | (2006.01) |
| ***A41D 31/14*** | (2019.01) |
| ***A41D 31/102*** | (2019.01) |
| ***A63B 71/10*** | (2006.01) |

(52) U.S. Cl.

CPC ..... *A41D 13/11* (2013.01); *A41D 13/1138* (2013.01); *A41D 31/102* (2019.02); *A41D 31/14* (2019.02); *A62B 18/025* (2013.01); *A63B 71/10* (2013.01); *A41D 2600/10* (2013.01); *A63B 2244/19* (2013.01)

(58) Field of Classification Search

CPC ..... A41D 13/11; A41D 13/1138; A41D 13/1161; A41D 31/14; A41D 31/102; A41D 2600/10; A62B 18/025; A63B 71/10; A63B 2244/19; A63B 71/12

See application file for complete search history.

(56) References Cited

U.S. PATENT DOCUMENTS

| | | | | |
|---|---|---|---|---|
| 4,300,240 | A * | 11/1981 | Edwards | A41D 13/1161 2/206 |
| 7,086,400 | B2 * | 8/2006 | Shigematsu | A41D 13/11 128/205.25 |
| 8,176,918 | B2 * | 5/2012 | Teng | A62B 23/025 128/206.12 |
| D670,038 | S * | 10/2012 | Andrews | D29/108 |

(Continued)

*Primary Examiner* — Katharine Gracz

(74) *Attorney, Agent, or Firm* — Maginot, Moore & Beck, LLP

(57) ABSTRACT

A skeleton support has a concave shape configured to fit around a nose and mouth of a user. The support includes a skeletal structure that defines a plurality of connecting regions which form a first common connection interface. A cover includes a mounting mechanism with a plurality of fastening units which form a second common connection interface corresponding to the first common connection interface. Each fastening unit is configured to removably engage a corresponding connecting region of the skeleton support to hold the cover together with the skeleton support and form a mask. Different skeleton supports or covers with a different size, shape, color, pattern, flexibility, or material that also include the corresponding common connection interface can be swapped out to adjust the mask.

12 Claims, 10 Drawing Sheets

(56) References Cited

U.S. PATENT DOCUMENTS 9,027,554 B2 * 5/2015 Lee ..... A62B 18/02 128/206.19
9,643,048 B1 * 5/2017 Danford ..... A61M 16/20
D820,974 S * 6/2018 Danford ..... D24/110.1
2003/0029454 A1 * 2/2003 Gelinas ..... A62B 18/025 128/205.27
2003/0205231 A1 * 11/2003 Shigematsu ..... A41D 13/11 128/206.21
2005/0139217 A1 * 6/2005 Chiam ..... A41D 13/11 128/206.19
2006/0085881 A1 * 4/2006 Gellis ..... A41D 13/11 2/9
2007/0266483 A1 * 11/2007 Probst ..... A41D 13/11 2/424
2008/0223370 A1 * 9/2008 Kim ..... A41D 13/11 128/206.17
2010/0024826 A1 * 2/2010 Sullivan, Jr. ..... A41D 13/1146 128/207.11
2010/0319105 A1 * 12/2010 Fairbanks ..... A41D 13/11 2/209.13
2011/0119815 A1 * 5/2011 Paulson ..... A42B 1/046 2/424
2011/0179540 A1 * 7/2011 Sutton ..... A41D 13/1107 2/9
2011/0247626 A1 * 10/2011 Chuang ..... A62B 23/02 128/206.19
2011/0277769 A1 * 11/2011 Teng ..... A62B 18/025 128/206.21
2012/0017911 A1 * 1/2012 Choi ..... A62B 18/025 128/206.19
2012/0042878 A1 * 2/2012 Woo ..... A62B 18/025 128/206.15
2012/0167891 A1 * 7/2012 Smaller ..... A41D 13/11 128/206.19
2013/0152930 A1 * 6/2013 Votel ..... A61M 16/1075 128/204.17
2014/0202469 A1 * 7/2014 Smaller ..... A62B 18/025 128/863
2014/0216479 A1 * 8/2014 Jeong ..... A41D 13/1138 128/863
2015/0034098 A1 * 2/2015 Schumacher ..... A62B 18/025 128/863
2016/0296773 A1 * 10/2016 Lin ..... A41D 13/1107
2017/0144000 A1 * 5/2017 Danford ..... A62B 7/10
2017/0157436 A1 * 6/2017 Hosmer ..... A62B 18/084
2017/0332710 A1 * 11/2017 Bot ..... A41D 13/1192
2018/0008848 A1 * 1/2018 Moulton ..... A62B 23/025

* cited by examiner

FACE MASK HAVING A FLEXIBLE SKELETON AND A FLEXIBLE SKELETON FOR A FACE MASK

RELATED APPLICATIONS

This application claims priority to U.S. Provisional Application No. 62/369,907, filed Aug. 2, 2016, the entirety of which is incorporated herein by reference in its entirety.

TECHNICAL FIELD

This disclosure relates generally to face masks and, more particularly, to face masks for cold-weather sporting activities.

BACKGROUND

Face masks are used to protect a user's face in a wide variety of applications. In particular, in winter weather sports such as skiing, snowboarding, and the like, a face mask is customarily used in order to protect the user from the cold, the wind, and other environmental factors. A common type of mask used for winter weather sports and other activities is known as a "balaclava" or alternatively as a "ski mask." Such a ski mask is generally an article in the form of a cloth headgear configured to expose only a part of the user's face.

While providing a basic level of protection from the environment, customary ski masks have several disadvantages. When wearing a ski mask that covers a user's mouth, a user's breath is trapped, at least to some extent, by the mask. In some instances, this can cause muffled breathing or speech, and can result in stale or deoxygenated air being concentrated within the mask. In some instances, moisture from the user's breath and sweat from the covered portions of the user's face are trapped by the mask. Such moisture can condense and fog up the user's goggles, or can condense on the mask itself. A moistened mask is not only uncomfortable to wear, but can also dirty the mask or freeze during use. A frozen mask, i.e., a mask with frozen condensation, loses much if not all of the thermal protection otherwise provided. A moistened mask can also cling to a user's face. These disadvantages can be at least partially avoided by using a mask that does not cover the user's mouth, with the caveat that the user's mouth is then unprotected from the environment.

While solid mouth or face portions have been used in an attempt to address the moisture issues discussed above, such solutions have several disadvantages. Solid portions on ski masks are generally heavy and can be uncomfortable to wear. Solid portions are also less adapted to protecting the user from the cold. Additionally, collisions or falls where the user's head or face comes into contact with the ground are common in many winter weather sports. Solid portions can make such falls uncomfortable or dangerous, and often result in the addition of padding which exacerbates the moisture issues.

Therefore, a ski mask that does not trap the user's breath or sweat would be beneficial. A ski mask that protects a user's mouth and nose from the environment without increasing a risk to the user's face in the case of a fall would also be beneficial.

SUMMARY

A mask according to this disclosure, in particular a ski mask, includes a skeleton portion and a cover portion. The skeleton portion has a concave skeletal structure configured to fit around a nose and mouth of a user. The cover portion is configured to fit around the skeleton portion, and has a mounting mechanism and an integral fastening device. The mounting mechanism is configured to engage with the skeletal structure of the skeleton portion and hold the cover portion in a mask shape together with the skeleton portion. The fastening device is configured to secure the mask on a face of the user In some embodiments, the skeletal structure of the skeleton portion defines a plurality of connecting regions, and the mounting mechanism has a plurality of fastening units corresponding to the plurality of connecting regions in the skeletal structure. Each fastening unit is configured to engage a corresponding connecting region.

In some embodiments, the fastening units are snap fasteners.

In some embodiments, the fastening device is a hook and loop fastener.

In some embodiments, the concave shape of the skeletal structure is configured to space the cover portion, at least in part, away from the mouth and nose of the user In some embodiments, the skeleton portion is flexible.

In some embodiments, the mounting mechanism is configured to hold the skeleton portion on an inside of the mask.

In some embodiments, the mounting mechanism is configured to removably engage the skeletal structure, such that the skeletal portion is removable from the cover portion.

A skeletal support for a mask according to this disclosure includes a concave shape and a skeletal structure. The concave shape is configured to fit around a nose and mouth of a user. The skeletal structure is formed by a plurality of interconnected ribs, and is configured to engage a flexible cover and shape the flexible cover around the skeletal support.

In some embodiments, the skeletal support is flexible.

In some embodiments, the skeletal support is formed, at least in part, with a thermoplastic elastomer.

In some embodiments, the skeletal structure is substantially symmetrical about a vertical axis.

In some embodiments, the skeletal structure includes a plurality of ribs that define a plurality of connecting regions, each connecting region demarked by respective ribs of the skeletal structure.

A mask kit according to this disclosure includes a first skeleton portion, and a first cover portion. The first skeleton portion has a concave skeletal structure configured to fit around a nose and mouth of a user. The skeletal structure defines a first common connection interface. The first cover portion includes a mounting mechanism that defines a second common connection interface configured to removably engage with the first common connection interface and hold the cover portion together with the skeleton portion to form a mask. The first cover portion further includes an integral fastening device configured to secure the mask on a face of the user.

In some embodiments, the mask kit further includes at least one of a further skeleton portion and a further cover portion. The further skeleton portion has a further concave skeletal structure configured to fit around a nose and mouth of a user and defining another first common connection interface. The further cover portion has a further mounting mechanism that defines another second connection interface configured to removably engage with the first connection interface. At least one of the first skeleton portion and the first cover portion is substitutable with the at least one of the further skeletal portion and the further cover portion to form the mask.

In some embodiments, the at least one of the further skeletal portion and the further cover portion has at least one of a different size, shape, color, pattern, flexibility, and material that is different from a corresponding quality of the at least one of the first skeleton portion and the first cover portion.

In some embodiments, the second common connection interface is configured to removably engage with the first common connection interface.

In some embodiments, the first skeleton portion and the first cover portion are flexible, and the first skeleton portion is resilient.

DETAILED DESCRIPTION

For the purposes of promoting an understanding of the principles of the embodiments described herein, reference is now made to the drawings and descriptions in the following written specification. No limitation to the scope of the subject matter is intended by the discussion of any one embodiment. This disclosure also includes any alterations and modifications to the illustrated embodiments and includes further applications of the principles of the described embodiments as would normally occur to one skilled in the art to which this document pertains, including the combination, substitution, or non-inclusion of various features from various embodiments.

Figure 1:
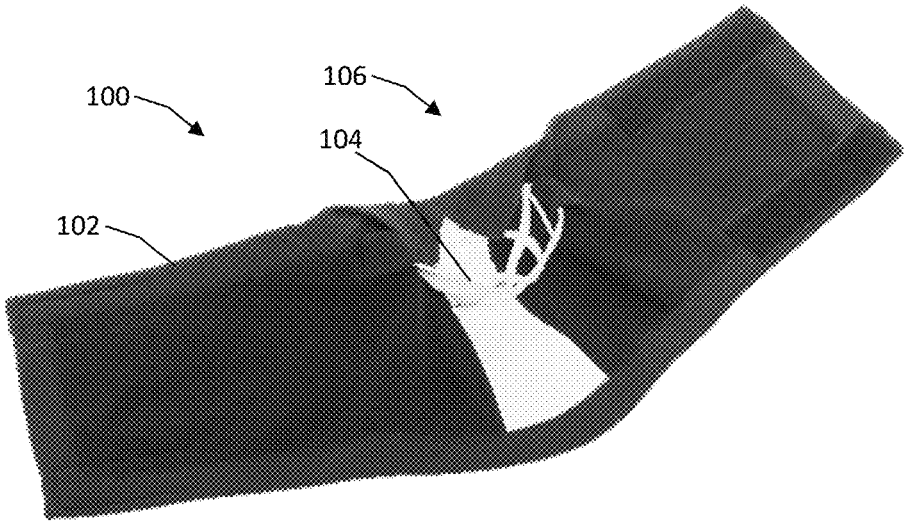
FIG. 1 is a perspective image illustrating an exemplary embodiment of a mask according to this disclosure.
Figure 2:
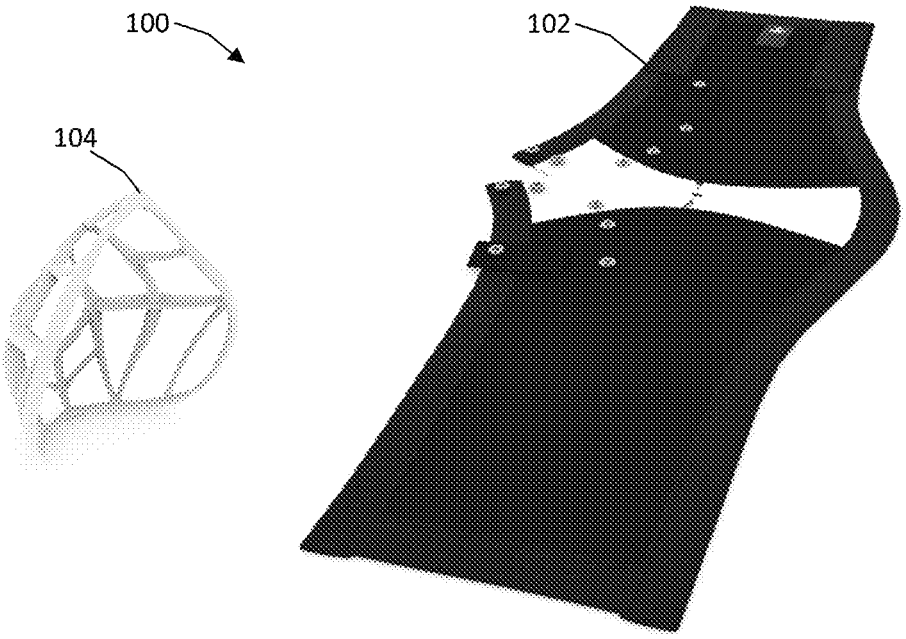
FIG. 2 is a perspective image of the mask from FIG. 1 in disassembled form.

FIG. 1 is a perspective image of a ski mask 100 according to this disclosure. The ski mask 100 includes a cover portion 102 and a skeleton portion 104. The skeleton portion 104 is engaged with the cover portion 102 so as to support the cover portion 102 and form the cover portion 102 into a mask shape 106. FIG. 2 is a perspective image of the ski mask 100 from FIG. 1 in disassembled form with the skeleton portion 104 removed from the cover portion 102. As illustrated in FIG. 2, without the skeleton portion 104 engaged therewith, the cover portion 102 lies substantially flat.

Figure 3:
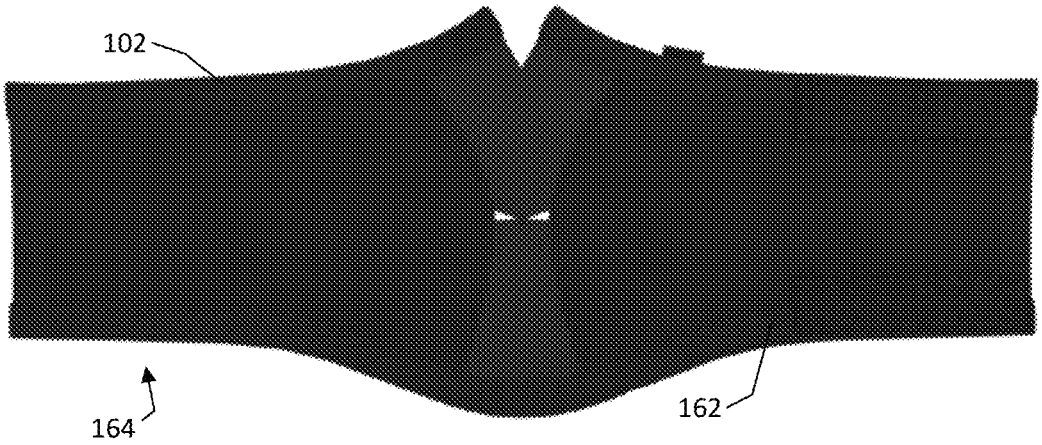
FIG. 3 is an outside view image of a cover portion of the mask from FIG. 1.
Figure 4:
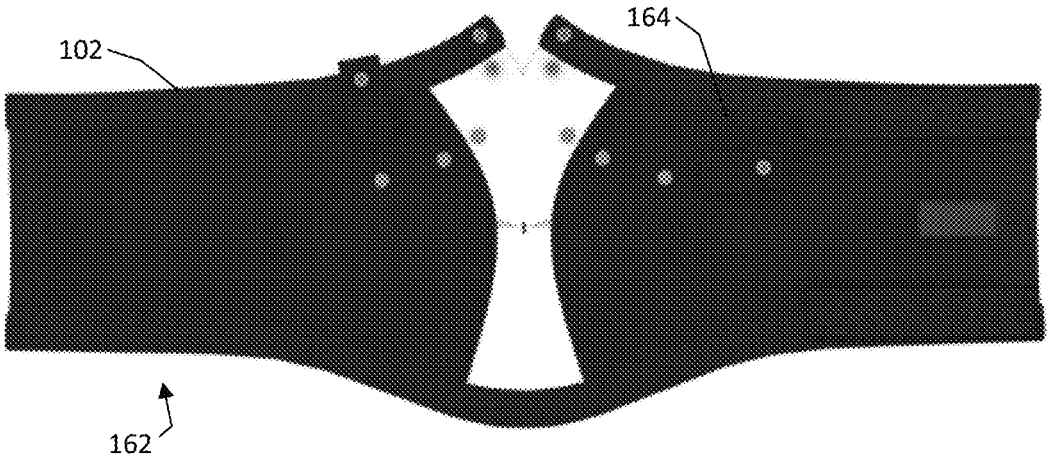
FIG. 4 is an inside view image of the cover portion from FIG. 2.
Figure 5:
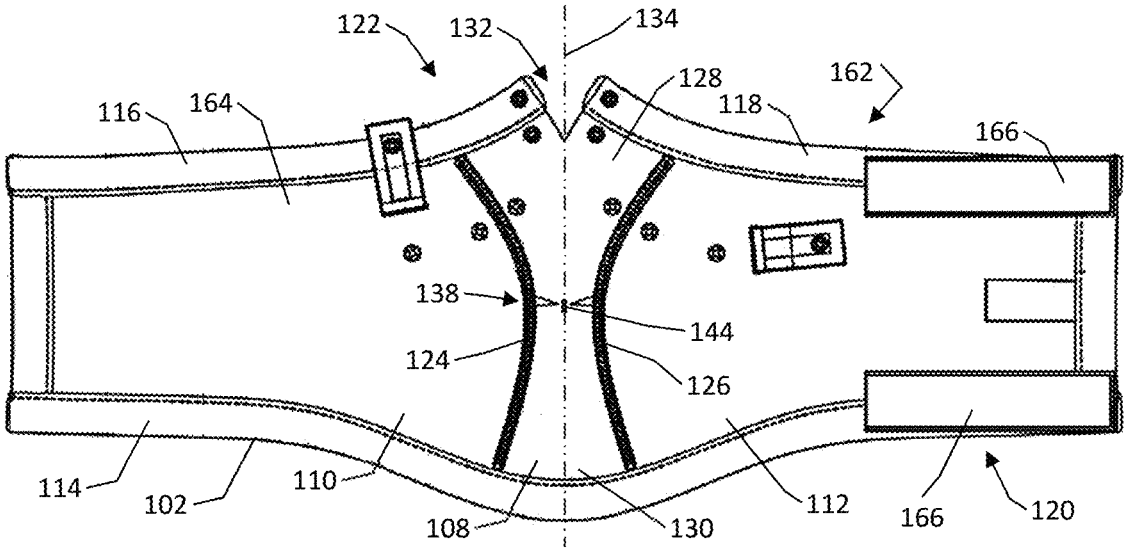
FIG. 5 is an inside view schematic of the cover portion from FIG. 2.
Figure 6:
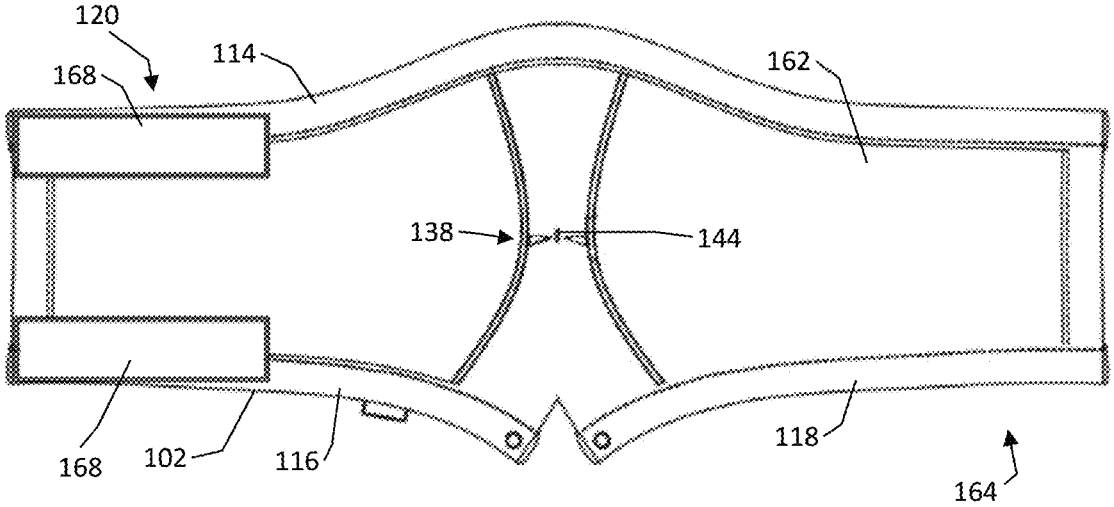
FIG. 6 is an outside view schematic of the cover portion from FIG. 2.
Figure 7:
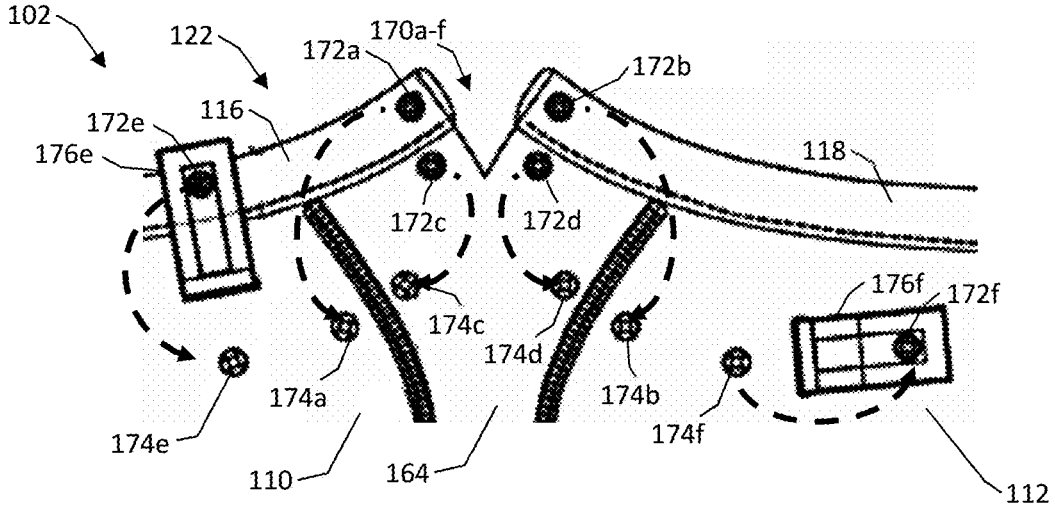
FIG. 7 is a detail view of FIG. 5.
Figure 8:
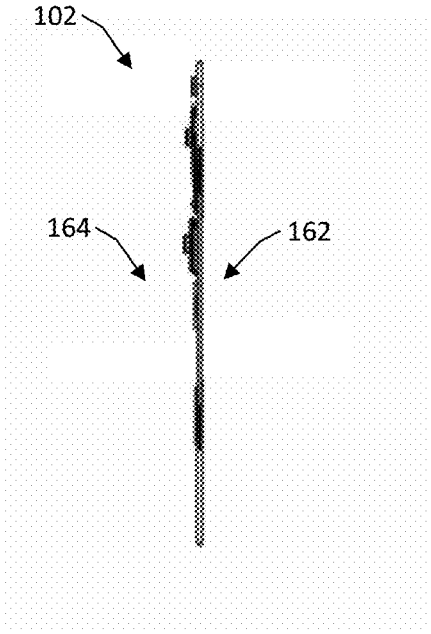
FIG. 8 is a side view schematic of the cover portion from FIG. 2.

FIGS. 3 and 4 are outside and inside images, respectively, of the cover portion 102, FIGS. 5 and 6 are inside and outside schematics, respectively, of the cover portion 102, FIG. 7 is a detail view of FIG. 5, and FIG. 8 is a side schematic of the cover portion 102. FIG. 6 is rotated 180 degrees relative to FIG. 5.

With particular reference to FIG. 5, the cover portion 102 includes a central portion 108, a first side portion 110, a second side portion 112, a bottom lining 114, a first top lining portion 116, a second top lining portion 118, a fastening device 120, and a skeleton mounting mechanism 122.

The central portion 108 has a substantially hour-glass-like shape with symmetrical first and second opposing concave side regions 124 and 126, respectively, a top region 128, and a bottom region 130. The top region 128 includes a v-shaped slit 132 that is aligned with a central axis 134 of the central portion 108 and that opens outwards toward the top region 128. In this embodiment, the bottom region 130 of the central portion 108 has a concave curved shape, but other shapes for the bottom region 130 are also contemplated in other embodiments.

The central portion 108 defines a vent 138. In this embodiment, the vent 138 is a pair of v-shaped slits opening outward toward the first and second side regions 126 and 126. Other acceptable shapes and locations of vents are also contemplated in other embodiments.

In this embodiment, the central portion 108 also includes a crease member 144 disposed along the central axis 134 and configured to define the central axis 134 as a bending axis 134 for the cover portion 102. In other words, the crease member 144 facilitates the bending of the cover portion 102 in a symmetrical fashion about the central axis 134.

The first and second side portions 110 and 112 are complementary with and attached to the first and second side regions 124 and 126 of the central portion 108, respectively. Any acceptable attachment technique can be used, such as stitching, bonding, riveting, etc. In some embodiments, the side portions 110 and 112 are integral with the central portion 108. In the embodiment illustrated in FIG. 5, side portion 110 and 112 each taper in a direction facing away from the central portion 108. The side portions 110 and 112 are shaped so as to be continuous with the shapes of the top region 128 and bottom region 130 of the central portion 108, and end, away from the central portion 108, in a substantially rectilinear shape.

The bottom lining 114 is complementary with and attached to the bottom of the side portions 110 and 112 and with the bottom region 130 of the central portion 108. The bottom lining 114 is folded over both an inside surface 162 (see, e.g., FIGS. 4 and 5) and an outside surface 164 (see, e.g., FIGS. 3 and 6) of the cover portion 102. Any acceptable attachment technique can be used to attach the bottom lining 114 to the side portions 110 and 112 and the central portion 108, such as stitching, bonding, riveting, etc.

The first top lining portion 116 and the second top lining portion 118 are each complementary with and attached to the top of the first and second side portions 110 and 112, respectively, and with the top region 128 of the central portion, and are substantially aligned with the v-shaped slit 132 in the top region 128 of the central portion 108. The first and second top lining portions 116 and 118 are also folded over both the inside surface 162 and outside surface 164 of the cover portion 102. In this embodiment, the first and second top lining portions 116 and 118 extend to the ends of the side regions 110 and 112, respectively.

The linings 114-118 enable the cover portion 102 to bend with limited wrinkling so as to generally maintain the mask shape 106 as the cover portion 102 is shaped around and by the skeleton portion 104.

While any acceptable fastening device can be used, in this embodiment, the fastening device 120 includes a fastening element 166 disposed on the inside surface 162 of the second side portion 112 (FIG. 5) and a fastening structure 168 disposed on the outside surface 164 of the first side portion 110 (FIGS. 4 and 6). In particular, in this embodiment, the fastening element 166 is a hooked fabric fastener 166, and the fastening structure 168 is a looped fabric fastener 168. The fastening element 166 is configured to removably engage with the fastening structure 168 in order to removably fasten the end regions 158 and 160 of the side portions 110 and 112 to each other. In this embodiment, the fastening element 166 is configured to engage with the fastening structure 168 in a variety of positions to enable an adjustable fit for the mask 100.

As illustrated in FIGS. 5 and 6, the fastening element 166 and the fastening structure 168 each include two parallel portions extending transverse to the side portions 110 and 112, respectively. This configuration enables the cover portion 102 to bend transversely to the central axis 134 without wrinkling or hindering the fastening device 120. Other shapes and locations for the fasting element 166 and fastening structure 168 are also contemplated in other embodiments.

The skeleton mounting mechanism 122 is configured to removably mount the skeleton portion 104 to the cover portion 102 so as to support the cover portion 102 and form the cover portion 102 into the mask shape 106 (FIG. 1). As illustrated in the detail view in FIG. 7, the skeleton mounting mechanism 122 includes a plurality of fastening units 170*a-f*. In this embodiment, the mounting mechanism 122 includes six fastening units 170*a-f*. In other embodiments, other numbers of fastening units are used.

Each of the fastening units 170*a-f* respectively includes a fastening element 172*a-f* and a corresponding fastening structure 174*a-f*. In this embodiment, the fastening units 170*a-f* include snap fasteners. In particular, in this embodiment the fastening elements 172*a-f* have female snap parts and the fastening structures 174*a-f* have male snap parts. In other embodiments, female and male snap parts can be exchanged, or any other acceptable type of fastener can be used, including ties, clips, screws, hook-and-loop fasteners, adhesives, etc.

Fastening units 170*a* and 170*b* are symmetrically disposed on the rear surface 164 of the cover portion. The fastening elements 172*a* and 172*b* are symmetrically disposed on the ends of the first and second top lining portions 116 and 118, respectively. The fastening structures 174*a* and 174*b* are symmetrically disposed on the side portions 110 and 112 proximate to the central portion 108 so that the fastening elements 172*a* and 172*b* and fastening structures 174*a* and 174*b* together define corners of a substantially trapezoidal shape that tapers toward the first and second top lining portions 116 and 118.

Fastening elements 172*c* and 172*d* and the corresponding fastening structures 174*c* and 174*d* are also symmetrically disposed on the rear surface 164 of the cover portion 102 so that the elements 172*c* and 172*d* and the corresponding fastening structures 174*c* and 174*d* together define corners of a substantially trapezoidal shape that tapers toward the top lining portions 116 and 118. The fastening elements 172*c* and 172*d* are closer together than the fastening elements 172*a* and 172*b*, and the fastening structures 174*c* and 174*c* are closer together than are the fastening structures 174*a* and 174*b* such that the fastening elements 172*c* and 172*d* and the corresponding fastening structures 174*c* and 174*d* are located within the trapezoid shape defined by the fastening elements 172*a* and 172*b* and fastening structures 174*a* and 174*b*.

In this embodiment, fastening element 172*e* and fastening structure 174*e* are not symmetrical with fastening element 172*f* and fastening structure 174*f*. In particular, the fastening unit fastening element 172*e* and fastening structure 174*e* are in a substantially vertical orientation with each other, while the fastening element 172*f* and fastening structure 174*f* in a substantially horizontal orientation with each other. Additionally, the fastening elements 172*e* and 172*f* are in each case disposed on a flap, 176*e* and 176*f* respectively, which supports the fastening elements 172*e* and 172*f*. The flaps 176*e* and 176*f* are configured to flex independently of the remainder of the cover portion 102 and enable the fastening elements 172*e* and 172*f* to engage the fastening structures 174*e* and 174*f*.

As discussed in further detail below, fastening the fastening units 170*a-f* so that each fastening element 172*a-f* is engaged to the corresponding fastening structure 174*a-f* shapes the cover portion 102 into the mask shape 106, and enables the removable installation of the skeleton portion 104 therein. While this embodiment includes six fastening units 170*a-f*, of which four fastening units are generally symmetrically oriented, other embodiments include other numbers of fastening units, include fastening units at other locations, or include fastening units in non-symmetrical configurations.

As illustrated in FIG. 8, the thickness of the cover portion 102 is relatively thin compared to the area of front and rear surfaces 162 and 164 (FIGS. 5 and 6). Generally, the cover portion 102, including the central portion 108, side portions 110 and 112, and the linings 114-118 (FIG. 5) include flexible materials, in particular flexible materials adapted for use in cold or harsh environments, or materials configured to resist accumulation of moisture such as breathable or hydrophobic materials. In this embodiment, the central portion 108 includes a rubber material, such as neoprene, and a remainder of the cover portion 102 includes a natural fabric material such as wool or fleece, a synthetic fabric such as polyester, or a combination thereof. In particular, in this embodiment, a remainder of the cover portion 102 includes a fabric that is approximately 80% fleece and approximately 20% polyester. In some embodiments, the side portions 110 and 112 and linings 114-118 also include a layer of another material such as neoprene or any other acceptable material.

In some embodiments, the central portion 108 includes a layer of fabric material, such as a fleece-polyester blend.

Figure 9:
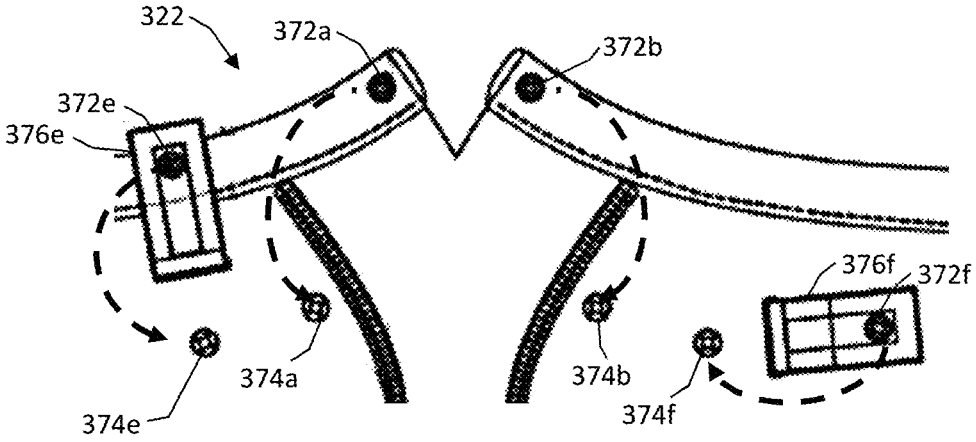
FIG. 9 is a detail schematic inside view of another exemplary embodiment of a cover portion for a mask according to this disclosure.

FIG. 9 is an inside schematic view of another exemplary embodiment of a mounting mechanism 322 of a cover portion for a mask according to this disclosure. Features which are similar to the features of the fastening mechanism 122 (FIGS. 5 and 7) are not discussed in further detail. In comparison to the six fastening units of the fastening mechanism 122, the mounting mechanism 322 instead includes four fastening units. In particular, the mounting mechanism 322 does not include the fastening elements 172*c* and 172*d* and fastening structures 174*c* and 174*d*. Decreasing the number of fastening units to four not only facilitates manufacturing, but also reduces the complexity of mounting a skeleton portion with the cover portion, without materially hindering the hold between the skeleton portion and cover portion or the mask shape formed via the mounting.

Figure 10:
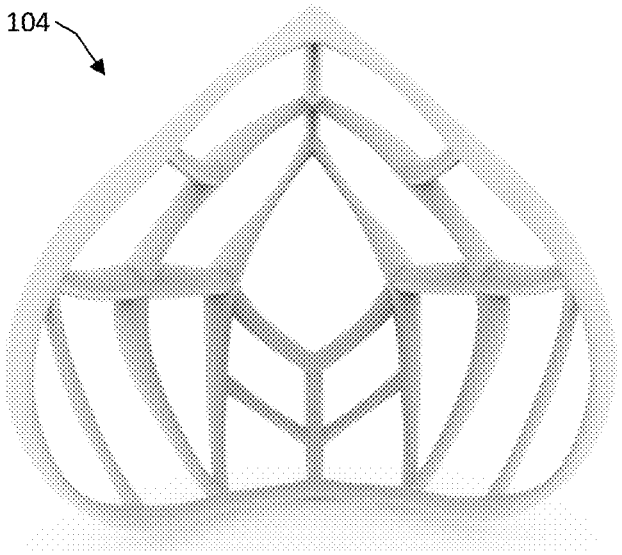
FIG. 10 is an inside view image of a skeleton portion of the mask from FIG. 1.
Figure 11:
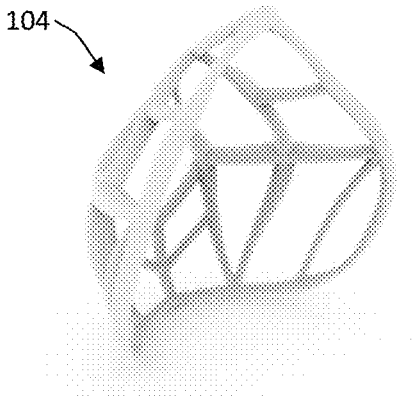
FIG. 11 is a right side perspective view image of a skeleton portion from FIG. 1.
Figure 12:
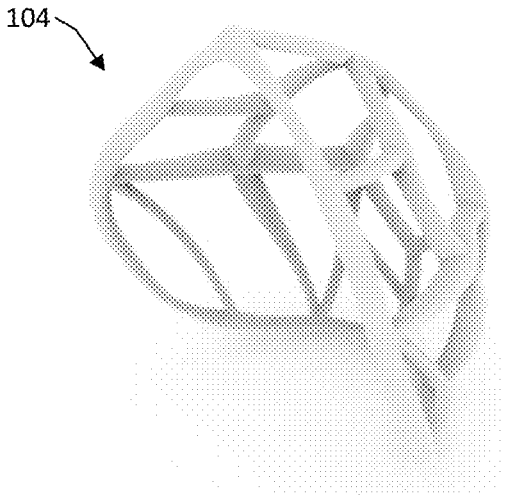
FIG. 12 is a left side perspective view image of a skeleton portion from FIG. 1.

FIGS. 10, 11, and 12 are rear, right side perspective, and left side perspective images, respectively, of the skeleton portion 104 from FIG. 1, and FIGS. 13-16 are top schematic, front schematic, right side schematic, and perspective schematics, respectively, of the skeleton portion 104.

Figure 13:
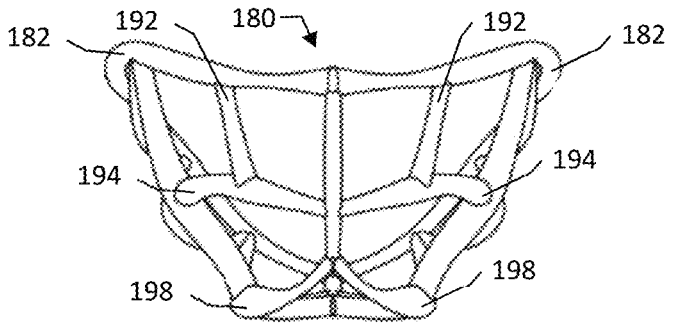
FIG. 13 is a top view schematic of a skeleton portion from FIG. 1.
Figure 14:
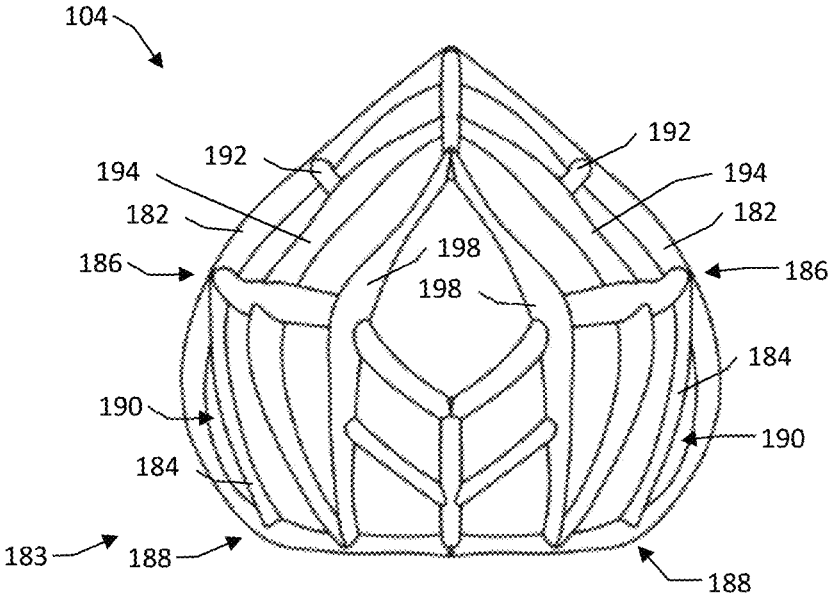
FIG. 14 is an outside view schematic of a skeleton portion from FIG. 1.

As illustrated in FIG. 13, the skeleton portion 104 includes a concave skeleton structure 180 formed by a plurality of inter-connected ribs. In particular, symmetrically disposed first ribs 182, when viewed from the rear as in FIG. 14, together form a shape 183 similar to a periphery of a surgical mask that is configured to fit around a nose and mouth of a human user.

Figure 15:
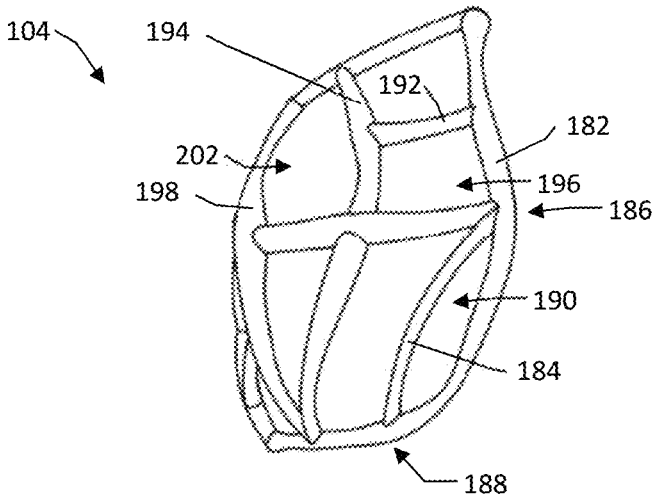
FIG. 15 is a left view schematic of a skeleton portion from FIG. 8.
Figure 16:
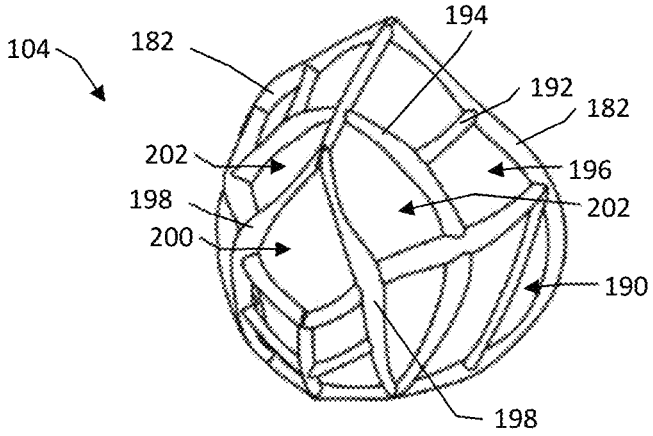
FIG. 16 is a perspective schematic of a skeleton portion from FIG. 8.

As illustrated in FIG. 15, second ribs 184 extend from an outermost portion 186 of each first rib 182 to a bottom portion 188 of the first rib 182 to define a first connecting region 190 between each second rib 184 and the corresponding first rib 182. A plurality of third ribs 192 support fourth ribs 194 that are symmetrically disposed inside of the contour formed by the first ribs 182 to define a second connecting region 196 between each of the forth ribs 194 and the corresponding first rib 182. As shown in FIG. 16, a plurality of fifth ribs 198 are also supported by at least a portion of the fourth ribs 194, and define a central opening 200 and a third connecting region 202 between each fourth rib 194 and the plurality of fifth ribs 198. As illustrated in FIGS. 10-16, in this embodiment, the connecting regions 190, 196, and 202 are in the form of gaps between adjacent ribs. These connecting gaps 190, 196, and 202 enable the fastening units 170*a-f* to pass therethrough, so as to connect the cover portion 102 to the skeleton portion 104, as discussed in more detail below.

The embodiment illustrated in FIGS. 10-16 shows one configuration of a skeletal structure 180 that defines the connecting regions 190, 196, and 202. Since the structure 180 is formed with a plurality of ribs, other regions of the skeletal portion 104 between adjacent ribs could also be used as connecting regions in other embodiments. In other words, the skeletal structure 180 may be compatible with a variety of different fastening mechanisms, such as the fastening mechanisms 122 and 322 discussed above and others.

Other shapes and sizes of skeletal structures are also contemplated. Any acceptable configuration that defines connecting regions so as to substantially correspond with a fastening mechanism on the cover portion can be used. In other words for different configurations of the fastening units, the connecting regions of the skeleton portion are located differently so as to correspond thereto. In this embodiment, each of the connecting regions 190, 196, and 202 is separated from the other regions via bones of the skeleton bone structure 180. In other embodiments, one or more of the connecting regions 190, 196, and 202 is contiguous with at least one other connecting region. Additionally, while this embodiment includes three sets of two symmetrical connecting regions, skeleton structures with other numbers of connecting regions, and non-symmetrical connecting regions are also contemplated.

In this embodiment, the skeleton portion 104 is configured to be flexible and resilient. The skeleton portion 104 in this embodiment includes a flexible material such as, for example a thermoplastic elastomer, and is formed by, for example, injection molding. Other materials and production techniques are also contemplated in other embodiments, and any acceptable production method can be used.

Figure 17:
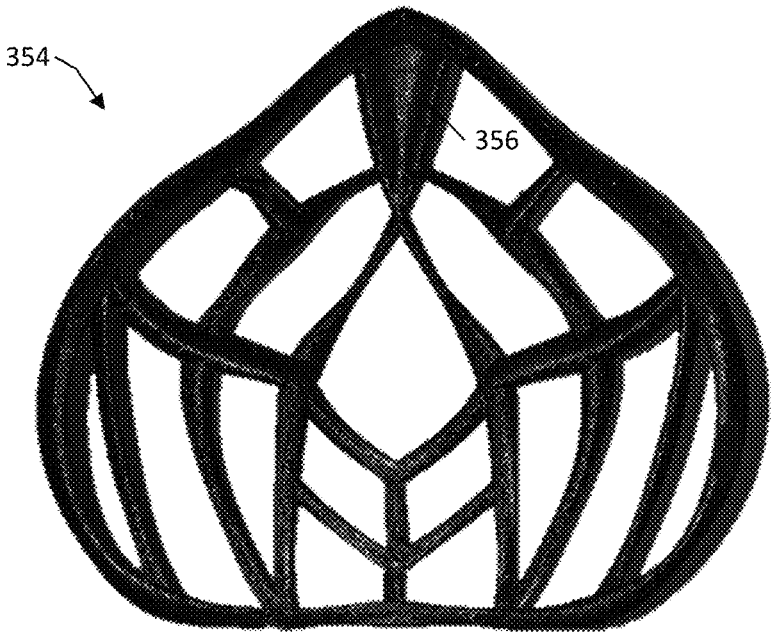
FIG. 17 is a front view schematic of another exemplary embodiment of a skeleton portion for a mask according to this disclosure.

FIG. 17 is another exemplary embodiment of a skeletal portion 354 for a mask according to this disclosure. Features which are similar to the features of the skeletal portion 104 (FIGS. 10-16) are not discussed in further detail. In comparison with the skeletal portion 104, the skeletal portion 354 further includes a bridge support 356. The bridge support 356 is configured to rest on or near the bridge of a user's nose, and enables the skeletal portion 354 to fit around a wider variety of sizes and shapes of human noses and mouths. The bridge support 356 also conforms with the concave shape of the skeletal portion 354, such that the portion of the bridge support 356 that contacts a user's nose is shaped to at least partially conform to the shape of the nose, which can also improve the fit of the skeletal portion 354 around the user's mouth.

Figure 18:
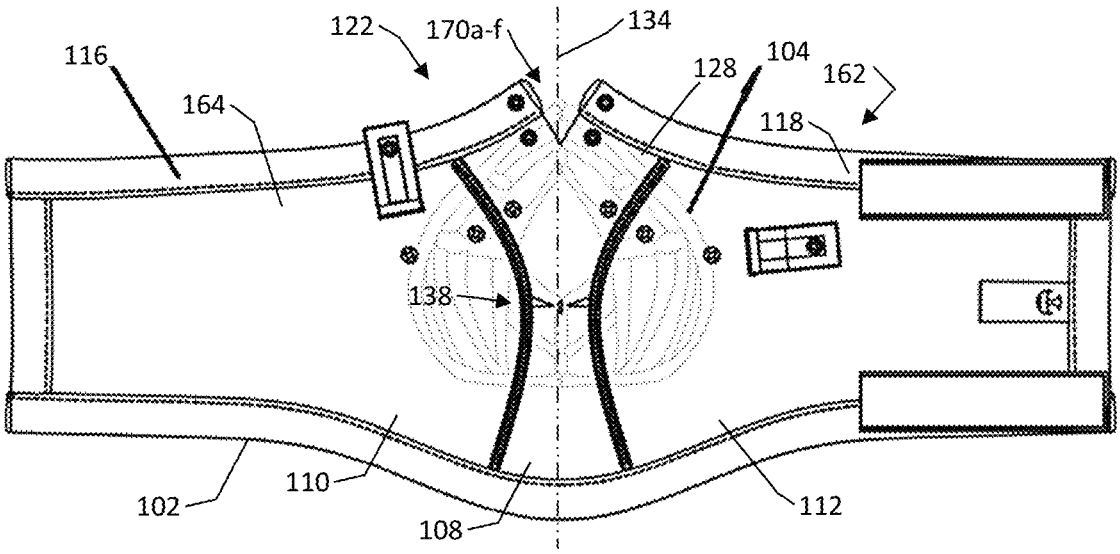
FIG. 18 is an inside view schematic of the skeleton portion and cover portion from FIG. 1 positioned for assembly.

FIG. 18 is a schematic that illustrates the skeleton portion 104 disposed on the rear surface 164 of the cover portion 102 prior to fastening of the fastening units 170*a-f*. To assemble the cover portion 102 and the skeleton portion 104 into the assembled mask 100 illustrated in FIG. 1, the top region 128 of the cover portion 102 is bent downward toward the vent 138 and the fastening units 170*a-f* are engaged to shape the cover portion 102 around the skeleton portion 104.

Figure 19:
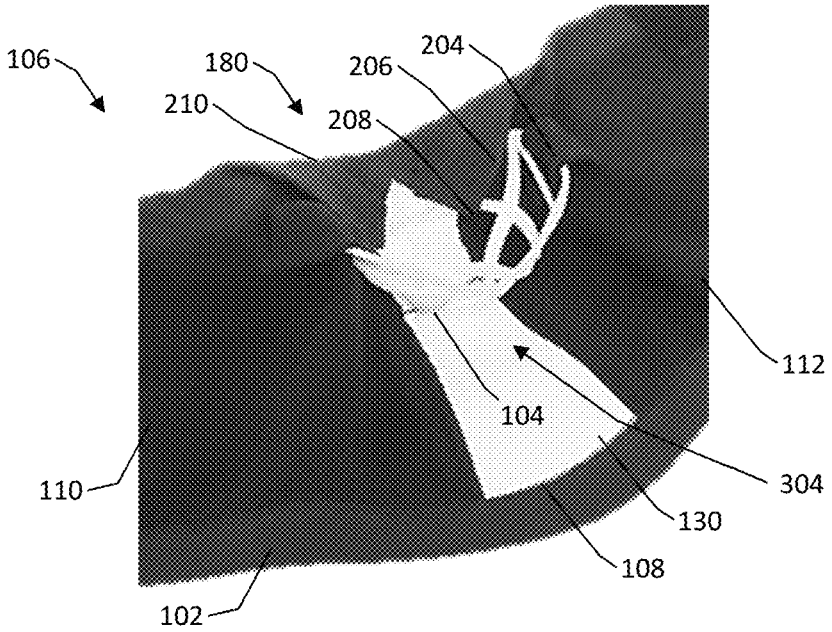
FIG. 19 is a perspective detail image of the assembled mask from FIG. 1.

FIG. 19 is an image that depicts the skeleton portion 104 mounted with the cover portion 102. Fastening elements 172*a* and 172*b* have been fastened to the fastening structures 174*a* and 174*b* to form a first connection 204 that passes through the first connecting region 190 of the skeletal portion 104. Fastening elements 172*c* and 172*d* have been fastened to the fastening structures 174*c* and 174*d* to form a second connection 206 that passes through the second connecting region 196 of the skeletal portion 104. The flaps 176*e* and 176*f* have been bent in order to align the fastening elements 172*e* and 172*f* with the fastening structures 174*e* and 174*f*, respectively, and fastening elements 172*e* and 172*f* have been fastened to the fastening structures 174*e* and 174*f* to form a third connection 208 that passes through the third connecting region 202 of the skeletal portion 104. In other words, as depicted in FIG. 19, the connections 204-208 between each of the fastening elements 172*a-f* and the corresponding fastening structure 174*a-f* passes through a corresponding one of the connecting gaps 190, 196, 202.

The connections 204-208 cause the cover portion 102 to flex around the skeleton portion 104, and hold the cover portion 102 to the skeleton portion 104 to form the mask shape 106 with a smooth contour 210 configured to rest over a user's nose. The skeleton portion 104 is configured to rest around the user's nose and mouth such that the user's nose and mouth are disposed within the concave skeleton structure 180 of the skeleton portion 104. Once the mask is assembled, a user can put on the mask by putting the skeletal portion 104 over the user's nose and mouth, and wrapping the side portions 110 and 112 around the user's neck in order to align and engage the fastening device.

Figure 20:
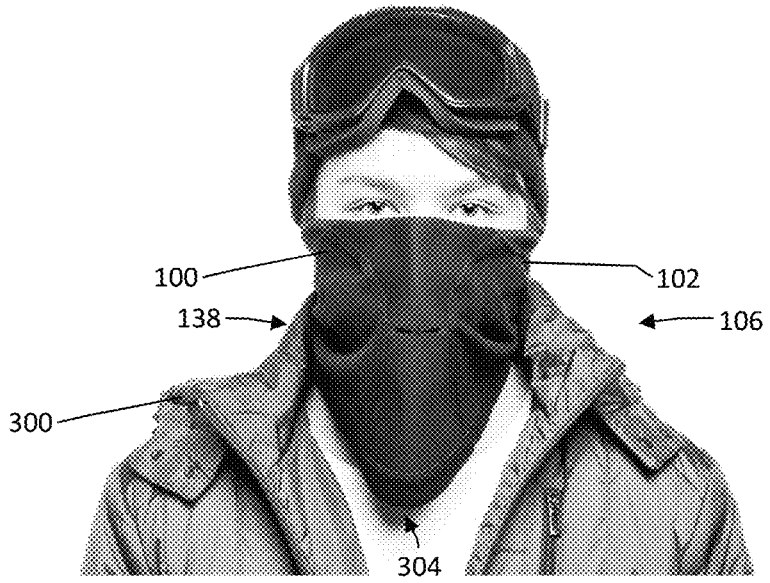
FIG. 20 is an image of the mask of FIG. 1 in use by a user.

FIG. 20 illustrates the assembled mask 100 in use being worn by a user 300. Due to the concave skeletal structure 180 of the skeletal portion 104 (FIG. 19), the cover portion 102 is spaced apart from the user's mouth and nose. Additionally, since the bottom region 130 of the central portion 108 is not connected to the skeletal portion 104 and may also form a gap 304 that, along with the vent 138, enables air and moisture to escape from within the mask 100.

In addition to distributing the weight of the mask 100 evenly about the user 300's face, the skeletal portion holds the cover portion 102 spaced apart from the user 300's face to enable unimpeded breathing and talking. The space between the user's nose and mouth and the cover portion 102 also impedes the material of the cover portion 102 from collecting sweat or other moisture from the user 300. The cover portion 102 also protects the user 300's face from the environment. Additionally, since the user's nose and mouth are disposed within the mask 100, at least a portion of the user 300's body heat that would otherwise be lost due to exhaled breath is captured and retained by the mask 100. The gap 304 and/or the vent 138 enable moisture within the mask 100 to escape in order to decrease a risk of fogging up ski goggles or other eyewear worn by the user 300. The heat retention, spacing between the cover portion 102 and the user's nose and mouth, and the venting of moisture out from the mask 100 also inhibit the mask 100 from freezing. The flexible material of the skeletal portion enables the mask 100 to maintain the mask shape 106 during use, but also to flex due to external forces such as in the event of a fall or collision.

In addition to decreasing manufacturing costs, the removable nature of the skeletal portion 104 enables different skeletal portions 104 and/or cover portions 102 to be swapped out. In one embodiment, a plurality of different cover portions have different shapes, colors, designs, materials, weights, etc., but each have a common mounting mechanism 122 such that the plurality of cover portions can each be selectively used with the same skeletal portion 104. In another embodiment, a plurality of different skeletal portions 104 have different shapes, sizes, weights, materials, colors, etc., but each have a skeletal structure that defines the common connecting regions 190, 196, and 202 such that the different skeleton portions can be selectively installed in the same cover portion 102.

In one embodiment, a mask according to this disclosure includes a cover portion and a skeleton portion. The skeleton portion includes a concave skeletal structure configured to fit around a user's nose and mouth, and that defines a plurality of connecting regions. The cover portion is configured to fit around the skeleton portion so as to form a mask shape, and includes a fastening unit assigned to each connecting region of the skeleton portion. The fastening units, once fastened, pass through the connecting regions of the skeleton portion and hold the cover portion together with the skeleton portion to form the mask.

In an embodiment, the cover portion includes a central portion and side portions, the side portions configured to fasten together in order to fasten the mask onto a user's face.

In another embodiment, the concave shape of the skeletal portion is configured to space the cover portion apart from the user's nose and mouth in order to facilitate breathing, talking, and heat retention, and in order to inhibit the cover portion from collecting moisture.

In a further embodiment, the skeleton portion is formed from flexible materials.

In one embodiment, the cover portion includes at least one of a fleece material, a polyester material, and a neoprene material.

In one embodiment, the fastening units are snap fasteners.

In an embodiment, the side portions of the cover portion include hook-and-loop fasteners that enable and adjustable fastening of the side portions together.

In another embodiment, the skeleton portion is removably mountable with the cover portion.

In a further embodiment, a plurality of different cover portions or skeleton portions having different shapes, colors, sizes, or materials each have a common attachment mechanism such that the different cover portions are interchangeable with the different skeleton portions.

In an embodiment, the cover portion of a mask includes at least one vent in a central portion. In different embodiments, the at least one vent can have a variety of shapes. In one embodiment, the at least one vent is triangular. In an embodiment, the at least one vent is symmetrically disposed on the cover portion.

In a further embodiment, the at least one vent includes a mesh covering material that is at least one of air and moisture permeable. In one embodiment, the at least one vent is at least partially open.

In another embodiment, the mounting mechanism is disposed on an outside surface of the cover portion so that, when mounted on the cover portion, the skeleton portion is disposed on an outside of the mask.

In an embodiment, the skeleton portion further includes hooks, and the mounting mechanism on the cover portion includes loops configured to receive the hooks. In one embodiment, the loops are positioned such that the cover portion is at least partially in tension due to the skeleton portion when the skeleton portion is mounted therein.

In another embodiment, the mounting mechanism of the cover portion includes at least one sleeve configured to at least partially receive the skeleton portion.

In a further embodiment, the mounting mechanism is at least partially disposed on the skeleton portion. In one embodiment, one of the fastening elements and fastening structures are disposed on the cover portion and the other of the fastening elements and fastening structures are disposed on the skeleton portion.

Different embodiments of masks according to this disclosure can include different combinations of features described above, along with any other advances or modifications that would be obvious to one of ordinary skill in the art. It will be appreciated that variants of the above-described and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the disclosure.

What is claimed is:

1. A mask, comprising:

a skeleton portion including a concave skeletal structure configured to fit around a nose and mouth of a user, the skeletal structure of the skeleton portion defining a plurality of connecting gaps; and a cover portion configured to fit around the skeleton portion, the cover portion including:

a plurality of fastening elements;

a plurality of fastening structures, wherein:

each of the plurality of fastening elements is configured to form a respective connection with a corresponding one of the plurality of fastening structures and together form a respective one of a plurality of fastening units;

positions of the plurality of connecting gaps in the skeletal structure corresponds to positions of the plurality of fastening units of the cover portion, such that the respective connection between each of the plurality of fastening elements and the corresponding one of the plurality of fastening structures is configured to pass through a corresponding one of the plurality of connecting gaps; and the cover portion and the skeleton portion are configured such that forming the connection between each of the plurality of fastening elements and the corresponding one of the plurality of fastening structures through the corresponding one of the plurality of connecting gaps connects the cover portion to the skeleton portion and causes the cover portion to flex around the skeleton portion and form a mask shape; and an integral fastening device configured to secure the mask on a face of the user.

2. The mask of claim 1, wherein the plurality of fastening units are snap fasteners.

3. The mask of claim 1, wherein the fastening device is a hook and loop fastener.

4. The mask of claim 1, wherein the concave shape of the skeletal structure is configured to space the cover portion, at least in part, away from the mouth and nose of the user.

5. The mask of claim 1, wherein the skeleton portion is flexible.

6. The mask of claim 1, wherein the plurality of fastening units are positioned so as to hold the skeleton portion on an inside of the mask.

7. The mask of claim 1, wherein the connection between each of the plurality of fastening elements and the corresponding one of the plurality of fastening structures is removable, such that the skeleton portion is removable from the cover portion.

8. A mask kit, comprising:

a first skeleton portion including a concave skeletal structure configured to fit around a nose and mouth of a user, the skeletal structure including a plurality of connecting gaps that define a first common connection interface;

a first cover portion including:

a plurality of fastening elements;

a plurality of fastening structures, wherein:

each of the plurality of fastening elements is configured to form a respective connection with a corresponding one of the plurality of fastening structures and together form a respective one of a plurality of fastening units;

the plurality of fastening units define a second common connection interface configured to removably engage with the first common connection interface and hold the cover portion together with the skeleton portion to form a mask;

positions of the plurality of connecting gaps in the first common connection interface correspond to positions of the plurality of fastening units of the second common connection interface, such that the respective connection between each of the plurality of fastening elements and the corresponding one of the plurality of fastening structures is configured to pass through a corresponding one of the plurality of connecting gaps; and the first cover portion and the first skeleton portion are configured such that forming the respective connection between each of the plurality of fastening elements and the corresponding one of the plurality of fastening structures through the corresponding one of the plurality of connecting gaps connects the first cover portion to the first skeleton portion and causes the first cover portion to flex around the first skeleton portion and form a mask shape; and an integral fastening device configured to secure the mask on a face of the user.

9. The mask kit of claim 8, further comprising at least one of:

a further skeleton portion with a further concave skeletal structure configured to fit around a nose and mouth of a user, the further skeletal structure defining another first common connection interface configured to removably engage with the second common connection interface; and a further cover portion including a further plurality of fastening units that define another second connection interface configured to removably engage with the first common connection interface;

such that at least one of the first skeleton portion and the first cover portion is substitutable with the at least one of the further skeleton portion and the further cover portion to form the mask.

10. The mask kit of claim 9, wherein the at least one of the further skeleton portion and the further cover portion has at least one of a different size, shape, color, pattern, flexibility, and material that is different from a corresponding quality of the at least one of the first skeleton portion and the first cover portion.

11. The mask kit of claim 8, wherein the second common connection interface is configured to removably engage with the first common connection interface.

12. The mask kit of claim 8, wherein:

the first skeleton portion and the first cover portion are flexible; and the first skeleton portion is resilient.

* * * * *